United States Patent [19]

Fukukura

[11] 4,450,331

[45] May 22, 1984

[54] KEY SWITCH ASSEMBLY HAVING MOMENTARY CLOSED INTERVAL

[75] Inventor: Kazutoyo Fukukura, Reading, Mass.

[73] Assignee: AMP Incorporated, Harrisburg, Pa.

[21] Appl. No.: 502,368

[22] Filed: Jun. 8, 1983

[51] Int. Cl.[3] ..... H01H 13/52

[52] U.S. Cl. ..... 200/160; 200/335; 200/340

[58] Field of Search ..... 200/153 T, 159 B, 160, 200/340, 335, 153 L

[56] References Cited

U.S. PATENT DOCUMENTS

| | | | |
|---|---|---|---|
| 3,367,206 | 2/1968 | Moody | 200/340 |
| 3,566,705 | 3/1971 | Frydman | 200/160 |
| 3,931,911 | 1/1976 | Kohl | 200/153 T |

FOREIGN PATENT DOCUMENTS

| | | | |
|---|---|---|---|
| 2848567 | 7/1979 | Fed. Rep. of Germany | 200/159 B |

*Primary Examiner*—John W. Shepperd
*Assistant Examiner*—Renee S. Kidorf
*Attorney, Agent, or Firm*—F. W. Raring

[57] ABSTRACT

Key switch assembly comprises a frame having a column in which a plunger is contained. The plunger is biased to an extended position by a spring and is movable to its depressed position. A bell crank is mounted adjacent to the column and has a camming arm which extends alongside the plunger and a switch closing arm. The plunger has a stiffly flexible camming rod and the column has a cam which flexes the camming rod during depression of the plunger so that it engages the camming arm and causes the switch closing arm to close the switch associated with the plunger and frame. The switch is closed for only a brief interval during depression of the plunger and the switch closing lever returns to its normal position after the camming rod moves past the cam.

9 Claims, 6 Drawing Figures

50
52
4
48
46
54
38
88
36
56
40
41
42
43
2
6
84
82
74
78
66
80
8
76
28
64
66
34
44
20
18
30
32
34
22
60
14
3
58
62
32
24
86
26
16
72
68
70
12

KEY SWITCH ASSEMBLY HAVING MOMENTARY CLOSED INTERVAL

FIELD OF THE INVENTION

This invention relates to key switch assemblies of the type used on a keyboard for a computer or the like. The invention is particularly directed to the achievement of a key assembly which has an N key rollover feature.

BACKGROUND OF THE INVENTION

Keyboards of the type used with computers or electronic typewriters comprise a pluarlity of key switch assemblies, one assembly being provided for each key position on the keyboard. A normally open switch is associated with each key switch assembly so that when a particular key is depressed, the associated switch is closed. The switch may be a membrane switch and the pulses or signals produced by depression of the keys are interpreted by the circuitry to produce the desired result.

Most key switch assemblies and the associated switches are designed such that when a particular key is depressed, the associated switch will be closed during downward movement of the key and will remain closed for a substantial time interval which extends from portion of the downward stroke of the key through a portion of the return stroke. When the operator depresses keys in succession at a rapid rate, it frequently happens that two or more switches will be closed at the same time; in other words, the closing intervals will overlap as between two keys which are depressed one after the other. When this happens, a false signal may be sent to the equipment associated with, or operated by, the keyboard and serious problems can result. For example, erroneous information might be generated and stored in a computer.

This problem has long been recognized and it is usually solved by building into the electronic equipment associated with the keyboard the ability to detect the operator's intention and transmit signals or pulses in response to the intention rather than in response to the signals which might be produced when two keys are depressed in rapid succession so that the associated switches are closed during an overlap time interval. This feature is usually referred to as N key rollover and is described, for example, in U.S. Pat. No. 3,745,536.

The present invention is directed to the achievement of a key switch assembly which has the N key rollover feature purely by virtue of its mechanical features so that it is unnecessary in the use of the keyboard to provide N key rollover features in the integrated circuits with which the keyboard is used.

A key switch assembly in accordance with the invention comprises a panel-like support, a pair of spaced-apart switch contacts on the support at a switch site and a frame on the support proximate to the switch site. The frame comprises a column extending normally of the support having a fixed end and a free end. A plunger is provided on the column which is normally maintained in an extended position relative to the support by a biasing spring and which is movably towards the support to a depressed position. A switch closing lever is pivotally mounted on the frame and is movable in response to movement of the plunger. The closing lever is effective electrically to connect the switch contacts to each other when it is moved. The key switch assembly is characterized in that the switch closing lever is a bell crank having a pivotal axis, a switch closing arm, and a cam follower arm. The pivotal axis is adjacent to the switch site and extends parallel to the plane of the panel-like support. The switch closing arm extends from the pivotal axis towards the switch site and has a free end which is proximate to, but normally spaced from, the switch contacts. The camming arm extends from the pivotal axis beside the plunger and has a free end which is spaced from the pivotal axis. The camming arm has a cam follower portion thereon. The plunger has a stiffly flexible camming rod extending from the upper end thereof towards the lower end. The camming rod has a camming portion which is angularly spaced from the cam follower portion of the camming arm, relative to the axis of the plunger, and which is moved past the cam follower portion during movement of the plunger to the depressed position. A cam deflector is provided on the frame proximate to the cam follower portion of the camming arm. The cam deflector has a deflecting surface which is engaged by the camming portion of the camming rod when the plunger is moved to the depressed position. The deflecting surface causes flexing of the camming rod laterally towards the cam follower portion of the camming arm with resulting engagement of the cam follower portion by the camming portion of the camming rod and resulting arcuate movement of the bell crank whereby the free end of the switch closing arm is moved towards the switch contacts and causes closing of the switch. The deflecting surface is of limited extent so that the camming rod returns to its normal position when the camming portion moves past the deflecting portion with resulting movement of the free end of the switch closing arm away from the switch contacts and opening of the switch. The switch contacts are thus electrically connected to each other only during a brief interval during movement of the plunger from the extended position to the depressed position.

In accordance with further embodiments, the switch contacts are opposed contacts on the substrate and the flexible membrane of a membrane switch. The switch closing lever is movably against the flexible membrane during movement of the plunger to the depressed position and is effective to flex the membrane towards the substrate and thereby engage the switch contacts with each other. In accordance with further embodiments, the frame has a base, the fixed end of the column is integral with the base, and the pivotal axis of the bell crank is in the base proximate to the fixed end of the column. The column has an axially extending opening therein extending from the fixed end to the free end and the plunger is slidably contained in the axially extending opening.

DESCRIPTION OF THE DRAWINGS

As shown in FIGS. 1–3, a key switch assembly 2 in accordance with the invention comprises a frame 3, the plunger 4, a biasing spring 6, a switch closing lever 8, and a key top 10 which is mounted on the upper end of the plunger 4. The frame may be of molded plastic material and comprises a base 12 having a column 14 extending therefrom. The column has a lower or fixed end 16, an upper free end 18, and an axially extending opening 20 extending therethrough from the free end through the fixed end and through the base 12. The column has oppositely facing side surfaces 22, 24 and end surfaces 26. Slots 28, 30 are provided in the side surfaces 22, 24 and communicate with the axially extending opening 20. The end surfaces 26 are stepped adjacent to the free end 18 as shown at 32 and slots 34 are provided in these end surfaces which extend from the free end 18 to the surfaces 32. The slots 28, 30, 34 receive radially extending arms on the upper end of the plunger 4 as will be described below.

Figure 2:
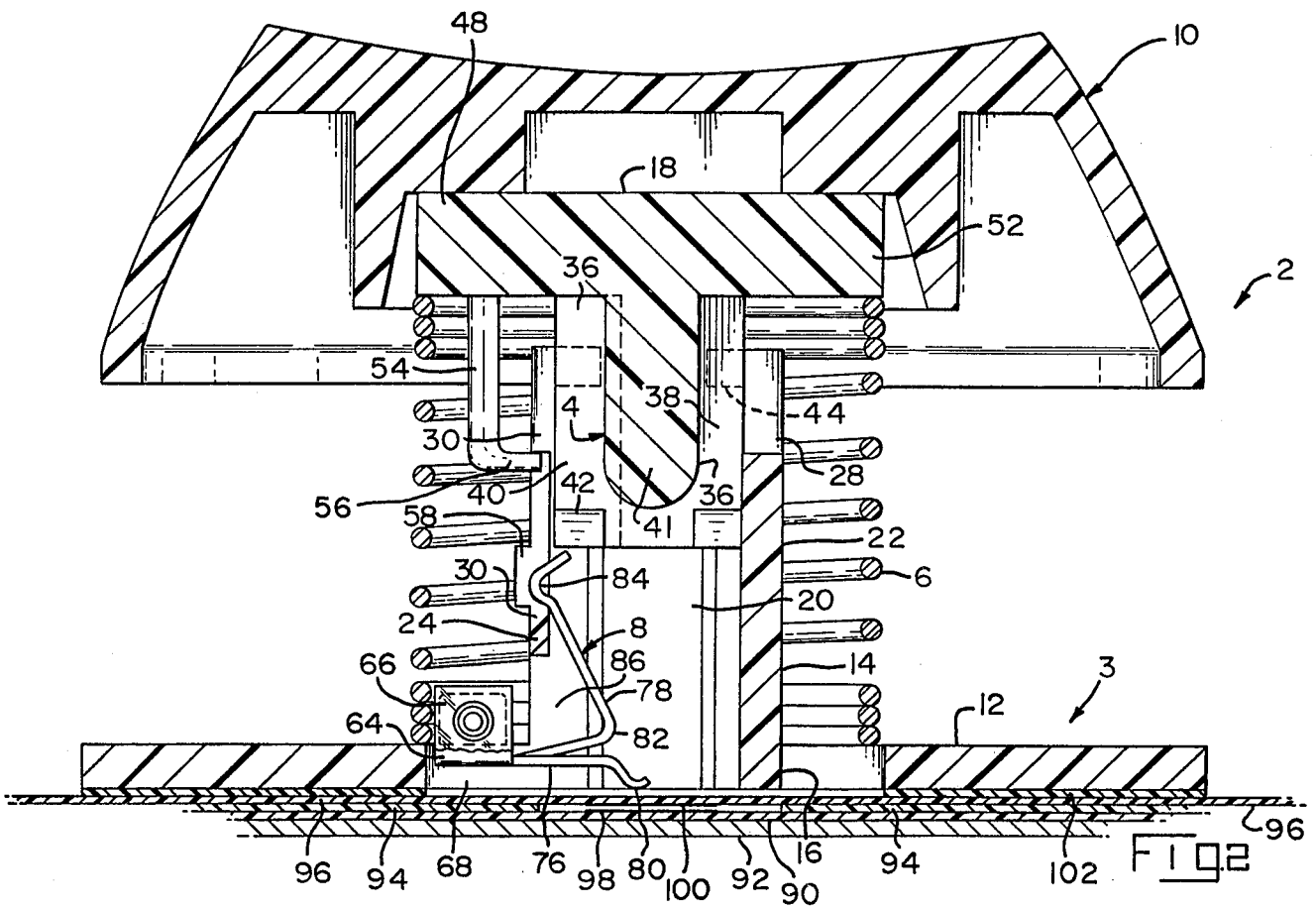
FIG. 2 is a cross-sectional view of the key switch assembly showing the positions of the parts immediately after the beginning of the downward stroke of the plunger.
Figure 3:
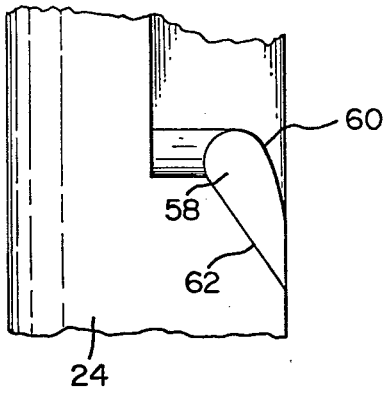
FIG. 3 is a view of a cam provided on the frame column for camming a camming rod into engagement with a switch closing lever.

The plunger comprises a cruciform plunger shaft 36 having oppositely directed projections 38, 40 and oppositely directed projections 41. The projections 38, 40 have upwardly facing shoulders 42 adjacent to the lower end 43 of the plunger for cooperation with downwardly facing shoulders 44 in the column 14. The shoulders 44 are proximate to the free end 18 of the column and the plunger can be assembled to the column by forcing the shaft portion thereof into the axially extending opening until the shoulders 42 are beneath the shoulders 44. The biasing spring 6 is mounted on the base 12 in surrounding relationship to the column 14 and bears against the arms 46, 48, 50, 52 as shown in FIG. 2.

These arms 46–52 extend radially from the upper or outer end of the plunger and are received in a recess in the under side of the key top 10, the arrangement being such that when the plunger is moved to its fully depressed position, portions of the arms 46–52 will be received in the slots 28, 30, 34.

A stiffly flexible camming rod 54 extends from the underside of the arm 48 and has an inwardly turned end portion 56 which functions as a cam follower in a manner described below. A cam 58 is provided on the side 24 of the column adjacent to the slot 30. The camming rod is normally located with its axis offset from the center line of the slot 30 and a deflecting surface 60 on the cam 58 engages the end 56 of the camming rod during an initial portion of the downward stroke of the plunger. The deflecting surface causes the camming rod to be flexed so that the inwardly turned end 56 engages the camming portion 84 of the switch closing lever as described below.

The switch closing lever 8 is essentially a bell crank having a U-shaped mounting portion 64 that has parallel spaced apart ears 66, a switch closing arm 76, and a camming arm 78. The U-shaped portion 64 is received in an opening 68 in the base 12 of the frame and is pivotally mounted on its pivotal axis by means of opposed bosses 72 on ears 70 which are provided on each side of the opening. The ears 66 of the closing lever have inwardly formed bosses 74 which when formed, produce spherical recesses in the ears 66. The recesses conform to the bosses 72 so that the bell crank switch closing lever can be moved in either direction about the pivotal axis.

The arms 76, 78 extend through an opening 86 in the side 24 of the column 14 and the switch closing arm 76 has a free end 80 which is substantially against the upper surface of a flexible membrane. The camming arm 78 is reversely formed as shown at 82 so that it extends alongside the plunger and towards the upper or free end 18 of the column. Clearance is provided for the camming arm by a slot 88 in the projection 40 of the shaft portion 36 of the plunger.

Adjacent to its upper end, the camming arm 78 has a camming portion 84 which projects through the slot 30 and beyond the plane of the side surface 24 of the column. This camming portion is located such that it is engaged by the inwardly directed portion 56 of the camming rod 54 as this inwardly directed portion moves downwardly from the position shown in FIG. 2. When the portion 56 of the camming rod engages the camming portion 84, the bell crank is swung through a slight clockwise arc and when the inwardly directed portion 56 moves past the cam 58, the camming rod returns to its normal position and the bell crank will be returned to its normal position.

Figure 1:
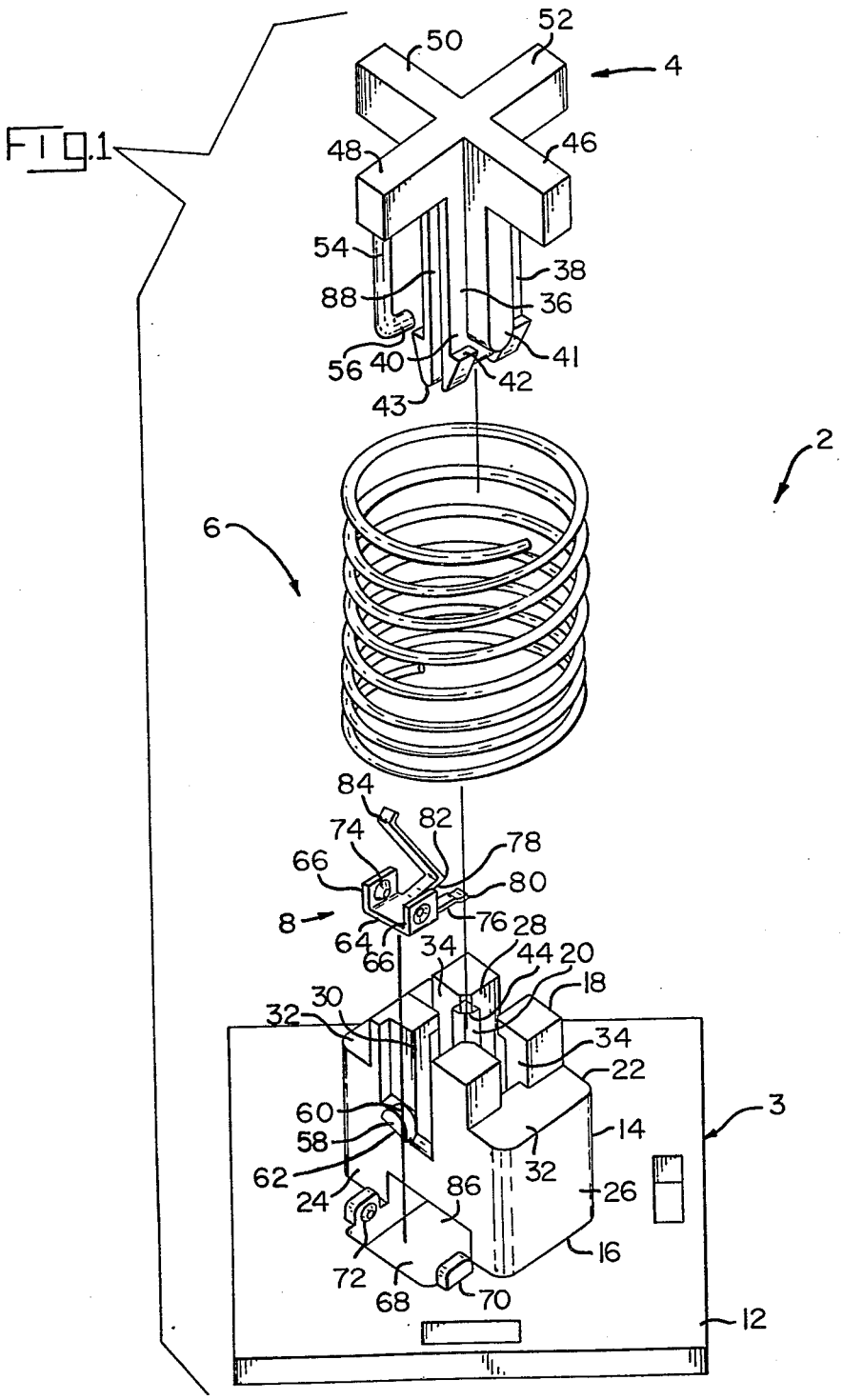
FIG. 1 is a perspective exploded view showing the essential parts of a key switch assembly in accordance with the invention.

During the return stroke of the plunger, the inwardly directed portion 56 engages the downwardly facing cam surface or deflecting surface 62 which is inclined leftwardly as viewed in FIG. 1 and the camming rod does not therefore engage the camming portion 84 of the camming rod. The type of cam described above and shown in the drawing is commonly used on key switch assemblies. For example, application Ser. No. 354,318, now U.S. Pat. No. 4,417,115, shows in FIGS. 9–18 two cams and a cam follower of the general class shown in the instant application. The essential features of this type of camming arrangement are a cam follower in the form of a laterally flexible rod on the plunger and a static cam on the column of the frame.

The key switch assembly 2 is shown as being mounted above switch electrodes 98, 100 on the substrate 90 and the flexible membrane 96 of a membrane switch. The substrate is separated from the flexible membrane by a separator 94 and the substrate in turn is supported on a rigid panel-like support 92. It will be understood that in a keyboard, the membrane and substrate will usually extend over the entire area of the keyboard with switch electrodes at each key site. In the disclosed embodiment, the key is secured in position by adhesive as shown at 102.

When the key is depressed, the camming rod moves past the cam 58 as explained above and the surface 60 causes deflection of the camming rod so that its inwardly turned end 56 engages camming portion 84 of the actuator lever 8. The actuator lever is swung through a slight arc and the electrodes 100, 98 are moved into contact with each other. When the inwardly turned portion 56 moves past the cam, the switch immediately opens and the parts return to their normal positions. The amount of force required to close the switch is very slight and the amount of force on the arm 76 to return the bell crank to its normal position is also very slight. In the disclosed embodiment, the bell crank is returned by the membrane 2. If desired, domes can be provided on the membrane to assist in returning the bell crank to its normal position.

Figure 4:
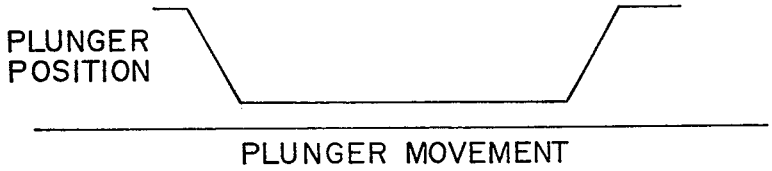
FIG. 4 is a diagram showing the movement of the plunger of a key switch assembly during a complete stroke of the key.
Figure 5:
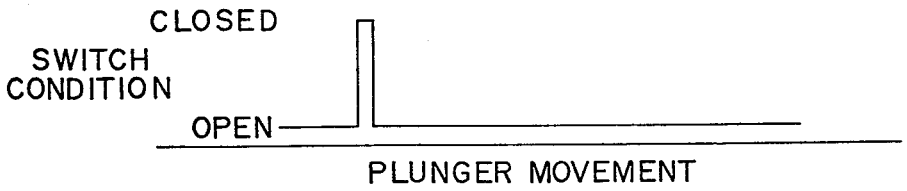
FIG. 5 is a diagram showing the condition of the switch during the stroke of a key switch assembly in accordance with the invention.
Figure 6:
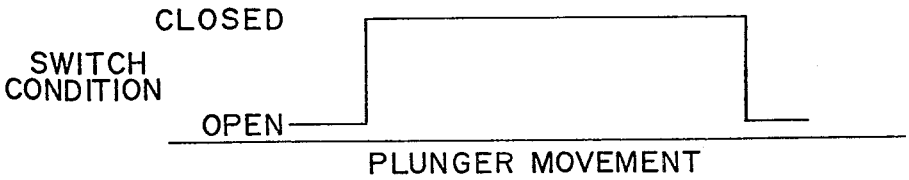
FIG.6 (PRIOR ART)
FIG. 6 is a diagram similar to FIG. 5 but showing the condition of the switch with a conventional prior art key switch assembly.

FIGS. 4–6 show the performance of a key switch assembly in accordance with the invention as compared with a conventional key switch assembly. FIG. 4 is a diagram illustrating the movement of the plunger from the extended position to the fully depressed position and back to the extended position when the operator depresses the key. As shown in FIG. 5, the associated membrane switch is open during most of this interval and is closed for only a brief interval while the plunger is being moved to its depressed position. The actual interval of switch closure will vary to some extent but can be as little as 3 milliseconds. Furthermore, the switch can be caused to close at the beginning of the downward stroke of the plunger rather than towards the end of the downward stroke of the plunger.

Because of the extremely short interval during which the electrodes 98, 100 are in contact with each other, it is virtually impossible in operating a keyboard to create the condition where two switches are held in a closed condition at the same time. As shown in FIG. 6, however, conventional key switch assemblies are designed such that the associated switch is held in a closed condition for a substantial time interval beginning during the downward stroke of the plunger and lasting through a portion of the return or upward stroke. It can be appreciated then that the generation of erroneous or false signals can frequently take place with conventional keyboard switches (FIG. 6) but is virtually impossible with a key switch assembly in accordance with the invention (FIG. 5).

I claim:

1. A key switch assembly of the type comprising a panel-like support, a pair of spaced-apart switch contacts on the support at a switch site, a frame on the support proximate to the switch site, the frame comprising a column extending normally of the support and having a fixed end and a free end, a plunger on the column which is normally maintained in an extended position relative to the support by a biasing spring, the plunger being movable towards the support to a depressed position, and a switch closing lever pivotally mounted on the frame which is movable in response to movement of the plunger and which is effective electrically to connect the switch contacts to each other, the key switch assembly being characterized in that:

the switch closing lever is a bell crank having a pivotal axis, a switch closing arm, and a cam follower arm, the pivotal axis being adjacent to the switch site and extending parallel to the plane of the panel-like support, the switch closing arm extending from the pivotal axis towards the switch site and having a free end which is proximate to, but normally spaced from, the switch contacts, the camming arm extending from the pivotal axis beside the plunger and having a free end which is spaced from the pivotal axis, the camming arm having a cam follower portion, the plunger having a stiffly flexible camming rod extending from the upper end thereof towards the inner end, the camming rod having a camming portion which is angularly spaced from the cam follower portion of the camming arm, relative to the axis of the plunger, and which moves past the cam follower portion during movement of the plunger to the depressed position, and a cam deflector on the frame proximate to the cam follower portion of the camming arm, the cam deflector having a deflecting surface which is engaged by the camming portion of the camming rod when the plunger is moved to the depressed position, the deflecting surface causing flexing of the camming rod laterally towards the cam follower portion of the camming arm with resulting engagement of the cam follower portion by the camming portion of the camming rod and arcuate movement of the bell crank whereby the free end of the switch closing arm is moved towards the switch contacts and causes closing of the switch, the deflecting surface being of limited extent whereby the camming rod returns to its normal position when the camming portion moves past the deflecting portion with resulting movement of the free end of the switch closing arm away from the switch contacts and opening of the switch whereby the switch contacts are electrically connected to each other only during a beief interval during movement of the plunger from the extended position to the depressed position.

2. A key switch assembly as set forth in claim 1 characterized in that the switch contacts are opposed contacts on the substrate and the flexible membrane of a membrane switch, the switch closing lever being movably against the flexible membrane during movement of the plunger to the depressed position and being effective to flex the membrane towards the substrate and thereby engage the switch contacts with each other.

3. A key switch assembly as set forth in claim 2 characterized in that the frame has a base, the fixed end of the column being integral with the base, the pivotal axis of the bell crank being mounted in the base proximate to the fixed end of the column.

4. A key switch assembly as set forth in claim 3 characterized in that the column has an axially extending opening therein extending from the fixed end to the free end, the plunger being slidably contained in the axially extending opening.

5. A key switch assembly as set forth in claim 4 characterized in that the column has an arm receiving opening therein at the fixed end thereof proximate to the pivotal axis of the bell crank, the switch closing arm and the cam follower arm extending through the arm receiving opening.

6. A key switch assembly as set forth in claim 5 characterized in that a slot is provided in the column extending from the free end towards the fixed end, the slot communicating with the axially extending opening in the column and being in alignment with the pivotal axis of the bell crank, the cam follower portion of the camming arm extending from the axially extending opening through the slot to the exterior of the column.

7. A key switch assembly as set forth in claim 6 characterized in that the plunger comprises a shaft portion which is received in the axially extending opening in the column, the column having an outer end which is located beyond the free end of the column when the plunger is in the extended position, the outer end having at least one radially extending portion, the camming rod extending from the radially extending portion.

8. A key switch assembly as set forth in claim 1 characterized in that the plunger has an outer end which is located beyond the free end of the column when the plunger is in the extended position, the outer end having at least one radially extending portion, the camming rod extending from the radially extending portion.

9. A key switch assembly as set forth in claim 8 characterized in that the column has an axially extending opening therein extending from the free end to the fixed end, the plunger being slidably contained in the axially extending opening.

* * * * *